United States Patent [19]

Liautaud

[11] 3,995,772

[45] Dec. 7, 1976

[54] NON-PRESSURIZED FLUID PRODUCT DISPENSER

[76] Inventor: James P. Liautaud, River and Bluff Roads, Trout Valley, Cary, Ill. 60013

[22] Filed: July 7, 1975

[21] Appl. No.: 593,575

[52] U.S. Cl. ..... 222/83.5

[51] Int. Cl.[2] ..... B65D 35/20

[58] Field of Search ..... 222/91, 83, 206, 211, 222/83.5, 213, 92, 99, 103, 89, 207, 215, 386.5, 389, 81, 214

[56] References Cited

UNITED STATES PATENTS

| | | | |
|---|---|---|---|
| 1,617,066 | 2/1927 | Lush | 222/81 |
| 2,082,706 | 6/1937 | Maggiora | 222/89 |
| 2,139,097 | 12/1938 | Pigyerez | 222/83 X |
| 3,223,289 | 12/1965 | Bouet | 222/214 X |
| 3,314,429 | 4/1967 | Boehm et al. | 222/83 X |
| 3,731,844 | 5/1973 | Baker | 222/83 |

*Primary Examiner*—Allen N. Knowles
*Assistant Examiner*—Norman L. Stack, Jr.
*Attorney, Agent, or Firm*—Lockwood, Dewey, Zickert & Alex

[57] ABSTRACT

A non-pressurized dispenser for fluid products includes a cylindrical plastic housing having a compressible body portion and a removable cap portion having a hollow core needle and dispensing nozzle. A disposable product container having flexible side walls is contained within the body portion. When the cap portion is seated on the body portion, the hollow core needle penetrates the container to establish fluid communication between the container and the nozzle. When the housing is compressed air trapped between the container and the housing causes the container to be compressed and the fluid product contained therein to be forced from the container through the core of the needle and out through the nozzle. A check valve in the housing allows air to enter the housing to replace the volume vacated by the dispensed fluid product so that the container can be completely emptied without the housing having to be completely compressed.

6 Claims, 3 Drawing Figures

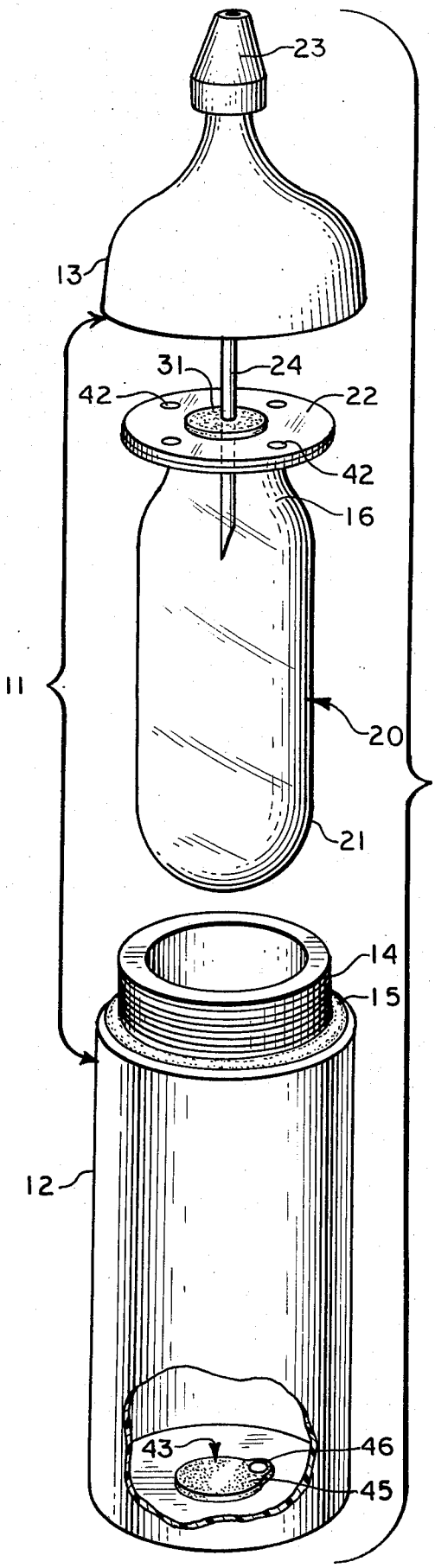
FIG. 1
FIG. 2
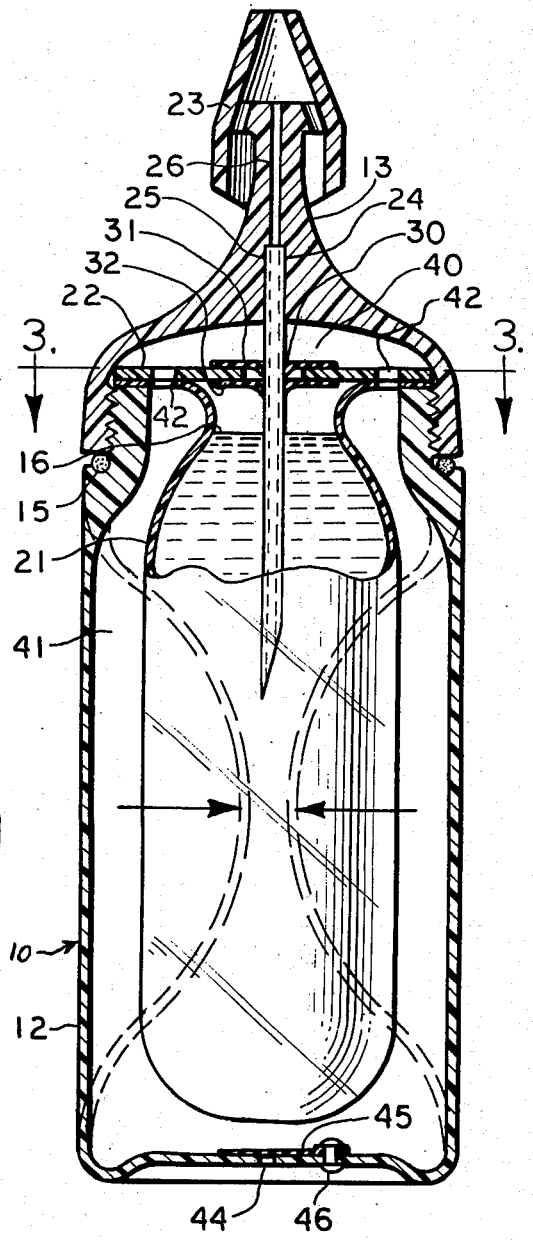
FIG. 3
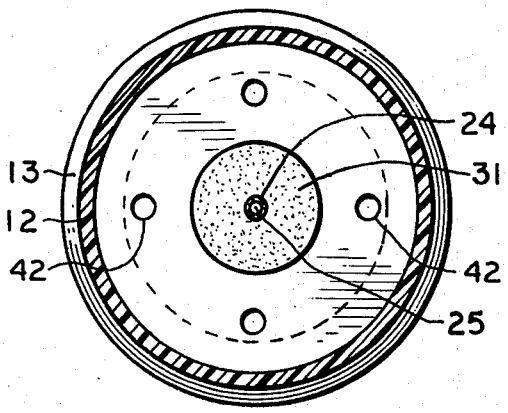

NON-PRESSURIZED FLUID PRODUCT DISPENSER

BACKGROUND OF THE INVENTION

The present invention relates generally to nonpressurized dispensers, and more particularly to a nonpressurized dispenser for use in conjunction with a disposable product container which is convenient to use and economical to manufacture.

Aerosol type containers, which have come into wide use for dispensing liquids such as paint, perfumes, hair sprays and the like, require that an inert gas be packaged under pressure with the liquid to be dispensed so that when the valve of the aerosol container is opened the product is dispensed as a spray as the gas escapes. The use of such dispensing agents is undesirable in that they contaminate the air when released, increasing the possibility of damage to plant and animal life. For this reason, and the relatively high cost of manufacturing aerosol containers, which cannot be refilled, the need has developed for a reusable nonpressurized product dispenser which does not require a gaseous dispensing agent.

Prior art attempts at providing non-pressurized product dispensers, wherein no dispensing agent is required and the product to be dispensed is contained in either a flexible bag or tube-like container, or in a memorized semiflexible container, and forced out of a nozzle at one end of the container by compressing the container, have not been entirely successful. In the case of the flexible bag or tube, it is not only often difficult to force the entire contents of the container out through the nozzle, but it is often difficult to provide satisfactory upright storage or packaging of the container. While forming the containers from a memorized plastic material in a cylindrical or rectangular shape facilitates storage, it makes it very difficult to compress the container sufficiently to force out the entire contents of the container. As a result, a portion of the contents of the container is often wasted, the container being discarded with usable but indispensable contents remaining within. Thus, a demand exists for a non-pressurized container which can be conveniently stored and which allows the entire contents of the container to be dispensed without waste.

Accordingly, it is a general object of the present invention to provide a new and improved non-pressurized product dispenser.

It is a further object of the present invention to provide a new and improved non-pressurized product dispenser which can be conveniently stored and which permits the entire contents of a product container to be dispensed.

It is another object of the present invention to provide a new and improved product dispenser having a nonpressurized disposable product container.

SUMMARY OF THE INVENTION

The invention is directed to a non-pressurized spray dispenser comprising a pressure-tight housing including a compressible body portion and a removable cap portion having a product dispensing nozzle therein, check-valve means in the housing for allowing air to enter the housing in the absence of a positive pressure differential therein, a sealed compressible product container disposed within the housing, and means in the cap portion for establishing fluid communication between the dispensing nozzle and the interior of the product container when the cap portion is attached to the body portion whereby the product in the container is dispensed through the nozzle when the housing is compressed.

The invention is further directed, for use in conjunction with a product dispenser of the type having a pressure-tight housing including a compressible body portion and a removable cap portion having a product dispensing nozzle therein, check-valve means in the housing for allowing air to enter the housing in the absence of a positive pressure differential therein, and a hollow needle in communication with the dispensing nozzle, the needle projecting into the body portion when the cap portion is installed thereon, to a product container comprising a flexible bag portion adapted to fit within the body portion, and a flange portion adapted to fit over the open end of the body portion, the flange portion including means for sealably passing the needle when the cap portion is installed on the body portion.

The invention is further directed to a dispenser for receiving a sealed non-pressurized product container of the type having a flexible bag portion comprising a pressure-tight housing including a compressible body portion and a removable cap portion having a product dispensing nozzle therein, check-valve means in the housing for allowing air to enter the housing in the absence of a positive pressure differential therein, and means in the cap portion for establishing fluid communication between the dispensing nozzle and the interior of the product container when the cap portion is attached to the body portion whereby the product in the container is dispensed through the nozzle when the housing is compressed.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in connection with the accompanying drawings, in the several figures of which like reference numerals identify like elements, and in which:

FIG. 1 is an exploded perspective view of the product dispenser of the invention.

FIG. 2 is an enlarged side elevational view partially broken away and partially in cross section showing the product dispenser in an assembled state.

FIG. 3 is a cross-sectional view taken along line 3—3 of FIG. 2.

DESCRIPTION OF THE PREFERRED EMBODIMENT

Referring now to the figures, and particularly to FIGS. 1 and 2, a product dispenser 10 constructed in accordwith the invention is seen to include deformable housing 11 consisting of a body portion 12 formed of a flexible plastic material memorized to assume a generally cylindrical shape when not under compression, and a contoured similarly formed cap portion 13. The cap portion is internally threaded to fit over an externally threaded annular portion 14 of reduced diameter provided on body portion 12 to form a pressure seal between the two housing sections. An O-ring 15 may be provided between the two housing portions to assist in maintaining the pressure seal.

The liquid or fluid product 16 to be dispensed is contained within a disposable flexible plastic container assembly 20 having a relatively flexible bag-like reservoir portion 21 of generally cylindrical form and a relatively inflexible flange portion 22 attached to the open end of the reservoir portion. The reservoir portion 21 is attached about the periphery of its open end to the flange portion to form a sealed integral assembly within which the product 16 is contained.

As shown in FIG. 2, the cap portion 13 of the housing 11 includes a nozzle 23 of conventional design. This nozzle, which may either be integrally molded into the cap portion, or which may be a separate component embedded therein, is arranged to dispense the liquid product 16 in spray form, the aperture and shape of the nozzle being arranged for a desired spray pattern. To establish fluid communication between nozzle 23 and the reservoir portion 21 of product container 20 the cap portion 13 of the housing includes a hollow downwardly projecting needle 24, one end of which is embedded in the body of the cap portion. The needle includes a central passageway 25, and communication is established between this passageway and nozzle 23 by means of an axially aligned passageway 26 molded into the body of the cap portion 13.

When the cap portion 13 is installed on the body portion 12 of housing 11 needle 24 is caused to puncture flange portion 22 so as to extend into the interior of the product container reservoir 21. To facilitate passage of the needle through the flange and to assist in maintaining a pressure-tight seal between the body of the needle and the flange, the flange is provided with a central needlereceiving aperture 30 and a pair of seals or membranes 31 and 32, which are affixed to the outer and inner surfaces or flange 22, respectively, so as to overly the aperture. These membranes, which may be formed of a thin sheet of rubber material, form a seal around the needle so that the liquid product can escape only through the central passageway 25 of the needle, and not around the circumference of the needle.

Since the membranes can be readily punctured by the needle, the flange portion 22 of the product container 20 can be formed relatively thick and inflexible to better serve as a support for the bag portion 21 of the container. The support provided by flange portion 22 is useful not only in positioning the container within the body portion 12 of the dispenser housing, but also serves to facilitate insertion of the needle into the container by providing a flat accessable surface for needle penetrations.

Once the needle is inserted through membranes 31 and 32, the cap portion 13 is turned onto the body portion 12 of the housing to establish a tight pressure seal. As this is done, it will be noted that a first cavity 40 is formed between the interior of the cap portion 13 and the top surface of flange 22, and a second cavity 41 is formed between the interior of body portion 12 and the exterior of the bag portion 21 of the product container 20. To prevent a pressure differential from developing between these cavities when the housing is squeezed or compressed by a user to dispense the fluid product 16, a plurality of apertures 42 are preferably provided through flange 22. These apertures serve to establish pressure communication between the two cavitities, thus preventing any pressure differential from developing and the flange portion from being deformed or pushed up when the flexible side walls of the body portion of the housing are compressed. As shown in FIG. 3, four such pressure relief apertures may be provided. However, it will be appreciated that a lesser or greater number can be provided as the application dictates.

To allow the housing to return to its non-compressed or memorized shape following each squeeze or compression, the bottom of the housing includes a flap-type check valve assembly 43. As shown in FIG. 2, this assembly includes an aperture 44 in the bottom wall of the housing and a flexible flap 45 disposed over the inside surface of this aperture by means of a rivet 46 or other suitable fastening means. When the side walls of the housing are compressed, the pressure within the housing is greater than the exterior pressure and the flap 45 prevents air within the housing from escaping through aperture 44. However, when the side walls are released flap 45 is displaced away from aperture 44 and exterior air is allowed to enter through aperture 44 to replace the volume previously occupied by the dispensed product, allowing the flexible side walls of the housing to return to their non-compressed cylindrical shape.

Absent check valve 43 a negative pressure differential would develop within the first and second voids of the housing as the volume occupied by the product in the flexible reservoir 21 of the product container 20 became reduced. This would not only prevent the flexible side walls of the housing from returning to their initial shape, but would also make it more difficult to dispense all of the product from the reservoir. Check valve 43 enables the first and second cavities of the housing to be completely filled with air, so that when the side walls of the housing are compressed the product reservoir is also immediately compressed. In this respect the air trapped within the housing functions as a medium for transferring the compressive effort exerted on the side walls of the housing onto the side walls of the reservoir portion of the product container. Since the cavities are maintained completely filled with air throgh check valve 43, the product reservoir can be completely collapsed and its entire contents dispensed without the less flexible housing having to be completely collapsed. Since the pressure differential is substantially the same on either side of flange 22 and membranes 31 and 32, there is little tendency for the fluid product to escape from the reservoir along the side wall of the needle where it enters the reservoir.

It is contemplated that product container 20 would be replaced with another container after its contents are completely dispensed, the same dispenser housing 11 serving to dispense the contents of subsequent containers containing either the same or a different product. While the dispenser housing has been shown as having a cylindrical memorized or non-compressed shape, it will be appreciated that it can be formed to have other shapes. For instance, it could be oval in cross section with either a round or oval cap portion. Furthermore, while the reservoir portion of the disposable product container has been shown to have a generally cylindrical form with a bulbous bottom end and an open top end, this container could be tubular in form with a crimp-sealed bottom end. Also, the flange portion of the product container could take other forms, such as an oval form to accomodate the aforementioned oval housing assembly.

While two membranes of rubber-like material are shown for establishing a seal between the needle and the flange portion of the product container, it will be appreciated that other sealing arrangements could be provided. For instance, the flange could be formed of a material suitable for puncture by the needle, in which case no center membrane need be provided. To this end, the center portion of the flange could be formed to have a lesser thickness than the other portions of the flange to facilitate puncture by the needle.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A non-pressurized dispenser comprising, in combination:

a pressure-tight housing including a body portion having compressible side walls and an opening at one end thereof, and a removable cap portion adapted for threaded engagement to said body portion over said opening, said cap portion having a product dispensing nozzle therein;

check-valve means in said housing for allowing air to enter said housing in the absence of a positive pressure differential therein;

a compressible product container disposed within said housing, said container having a relatively flexible bag portion within said body portion and a relatively inflexible flange portion at one end of said bag portion adapted to fit over said opening under said cap portion, said flange portion being manipulated in a seated position against the rim of said opening by said cap portion and including a relatively thin membrane portion serving as a sidewall for said bag portion; and means including a hollow needle in said cap portion having a passageway communicating with said nozzle for penetrating said membrane portion when said cap portion is installed on said body portion whereby the product in said container is dispensed when said housing is compressed.

2. A non-pressurized dispenser as defined in claim 1 wherein said flange portion comprises a relatively thick member, and said membrane portion comprises an aperture disposed in said member for accommodating said needle, said aperture being sealed by means including a thin membrane overlying said aperture.

3. A non-pressurized dispenser as defined in claim 1 wherein a first air chamber is formed between said bag portion and said body portion, and wherein a second air chamber is formed between said flange portion and said cap portion, and wherein said flange portion includes at least one aperture for establishing pressure communication between said first and second air chambers.

4. For use in conjunction with a product dispenser of the type having a pressure-tight housing including a body portion having compressible side walls and an opening at one end thereof, and a removable cap portion adapted for threaded engagement with said body portion over said opening, said cap portion having a product dispensing nozzle therein, check-valve means in said housing for allowing air to enter said housing in the absence of a positive pressure differential therein, and means including a hollow needle in said cap portion having a passageway communicating with said dispensing nozzle, said needle projecting into said body portion when said cap portion is installed thereon;

a product container comprising, in combination:

a flexible bag portion adapted to fit within said body portion; and a relatively inflexible flange portion at one end of said bag portion adapted to fit over said opening in said body portion under said cap portion so as to be retained in a seated position against the rim of said opening, said flange portion including a relatively thin membrane portion serving as a sidewall for said bag portion for sealably passing said needle to establish fluid communication with said bag portion when said cap portion is installed on said body portion.

5. A product container as defined in claim 4 wherein said flange portion comprises a relatively thick member, and said membrane portion comprises an aperture disposed in said member for accommodating said needle, said aperture being sealed by means including a thin membrane overlying said aperture.

6. A product container as defined in claim 5 wherein a first air chamber is formed between said bag portion and said body portion, and wherein a second air chamber is formed between said flange portion and said cap portion, and wherein said flange portion includes at least one aperture for establishing pressure communication between said first and second air chambers.

* * * * *